United States Patent [19]

Stafford et al.

[11] Patent Number: 4,567,942

[45] Date of Patent: Feb. 4, 1986

[54] SHELL AND TUBE FALLING FILM HEAT EXCHANGER WITH TUBES IN CONCENTRIC RINGS AND LIQUID DISTRIBUTION BOX

[75] Inventors: Donald C. Stafford, Hinsdale; Tushar K. Shah, Cresthill; Vincent F. Allo, Warrenville, all of Ill.

[73] Assignee: Chicago Bridge & Iron Company, Oak Brook, Ill.

[21] Appl. No.: 472,263

[22] Filed: Mar. 4, 1983

[51] Int. Cl.[4] ..... F28D 3/02; F28D 3/04; B01D 1/00; A23C 3/04

[52] U.S. Cl. ..... 165/118; 165/115; 165/134.1; 62/123

[58] Field of Search ..... 165/118, 115, 174, 134 R; 62/123, 310; 137/561 A, 262; 222/478; 159/13 A, 13 B, 13.1, 13.2, 43 R, 27 D, 25.2; 202/236, 237

[56] References Cited

U.S. PATENT DOCUMENTS

| | | | |
|---|---|---|---|
| 1,174,371 | 3/1916 | Wegner | 137/242 |
| 1,437,698 | 12/1922 | Wirth-Frey | 159/25 A |
| 2,547,794 | 4/1951 | Stone | 137/262 |
| 2,610,646 | 9/1952 | Michaelso et al. | 137/262 |
| 3,015,340 | 1/1962 | Montz et al. | 137/262 X |
| 3,265,124 | 8/1966 | Reys | 165/133 |
| 3,849,232 | 11/1974 | Kessler et al. | 159/13.2 |
| 4,335,581 | 6/1982 | Nail | 62/123 |
| 4,341,085 | 7/1982 | Nail | 62/124 |

FOREIGN PATENT DOCUMENTS

| | | | |
|---|---|---|---|
| 756093 | 2/1971 | Belgium | 159/13 |
| 176175 | 2/1905 | Fed. Rep. of Germany | 159/13 B |
| 1335975 | 10/1962 | France | 159/13 A |
| 613989 | 12/1960 | Italy | 159/25.2 |
| 0772562 | 10/1980 | U.S.S.R. | 202/236 |
| 0965437 | 10/1982 | U.S.S.R. | 159/13 A |

*Primary Examiner*—William R. Cline
*Assistant Examiner*—John K. Ford
*Attorney, Agent, or Firm*—Marshall, O'Toole, Gerstein, Murray & Bicknell

[57] ABSTRACT

A falling film heat exchanger of the shell and tube type has the tubes positioned in concentric rings. A liquid distribution box is positioned above the tube upper ends. Short pipes extend downwardly from the box to feed liquid between the rings of tubes to distribute the liquid uniformly to the tubes. The box desirably rotates slowly. Also, the pipes desirably extend between upwardly extending tube ends so as to provide a uniform pool of liquid which overflows uniformly into the tubes.

8 Claims, 9 Drawing Figures

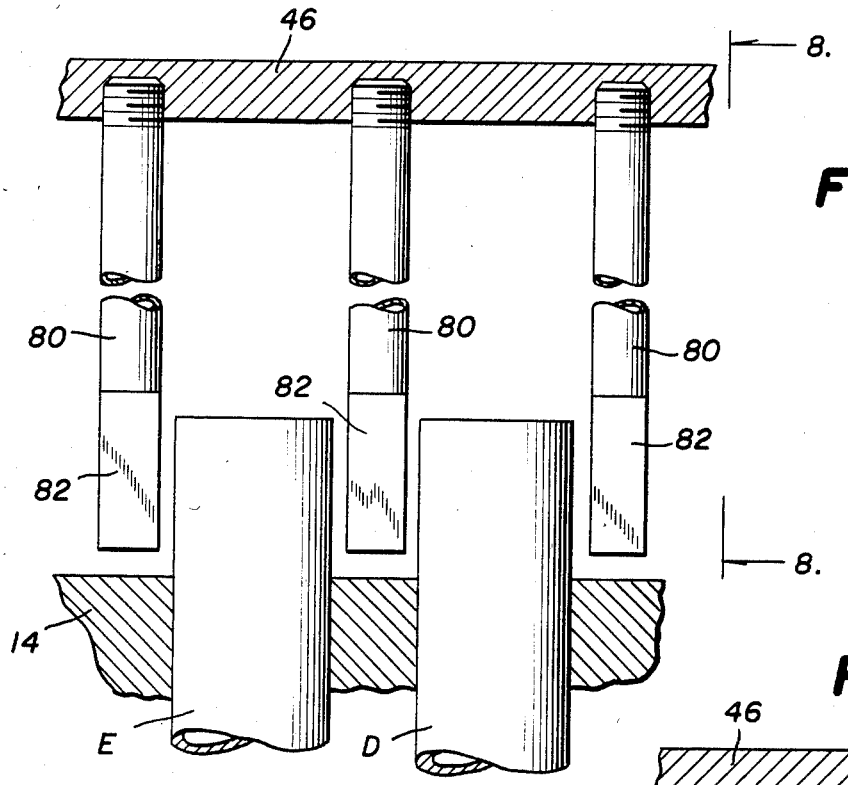
FIG. 7
FIG. 8
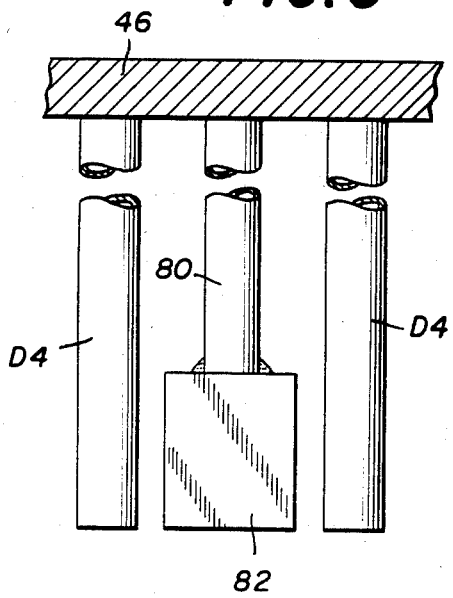
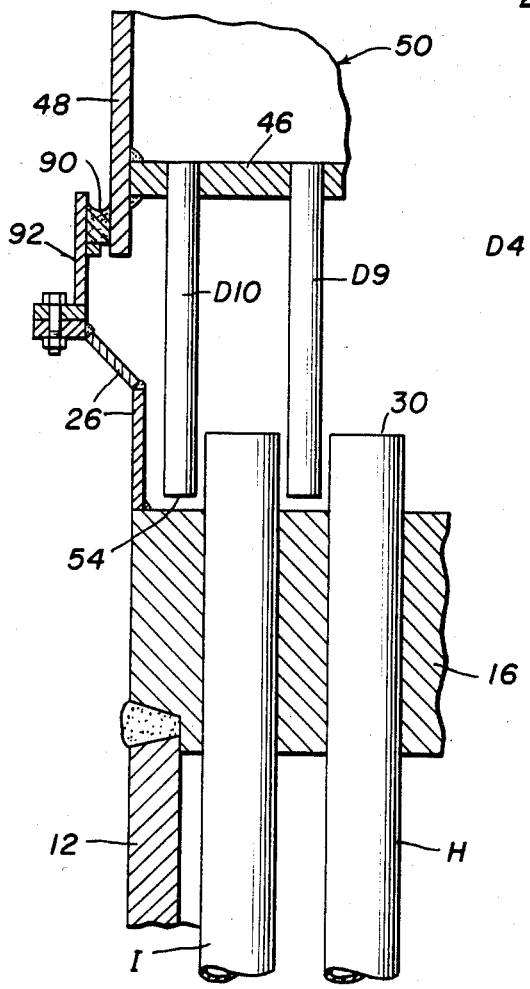
FIG. 9

SHELL AND TUBE FALLING FILM HEAT EXCHANGER WITH TUBES IN CONCENTRIC RINGS AND LIQUID DISTRIBUTION BOX

This invention relates to shell and tube falling film heat exchangers. More particularly, this invention is concerned with an improved heat exchanger which has the tubes arranged in radially concentric circles and means for uniformly distributing the feed liquid to the tubes.

BACKGROUND OF THE INVENTION

Shell and tube heat exchangers have an array of tubes extending between and through two spaced apart tube sheets surrounded by a shell. The shell is provided with an inlet and an outlet so that a suitable heat exchange liquid or gas can be circulated through the shell to cool or heat a liquid flowing through each tube.

Each end of the array of tubes can be left open, or exposed, for use in some processing operations. For other operations, one or both ends can be enclosed by a liquid retaining header, which may or may not have a removable cover or access port. When only one liquid header is present, it can be either a liquid inlet or liquid outlet. When a liquid header is positioned at each end, one liquid header can constitute a liquid inlet while the other can be a liquid outlet. Such an arrangement is conventional for once-through or single pass heat exchangers. The liquid inlet and outlet headers, or portions thereof, are provided with suitable conduit means for supplying and removing liquid.

Although shell and tube heat exchangers are generally used to heat a liquid feed stream, they can be used for cooling such a stream. Shell and tube heat exchangers of the described types can be used as freeze exchangers for producing fresh water from brackish water and seawater, for concentrating fruit and vegetable juices, and in industrial crystallization processes. As the liquid flows through each tube, it can be cooled enough to crystallize a solid from the liquid. Thus, by cooling seawater, ice is obtained which when separated, washed and melted provides potable water. When a fruit or vegetable juice is similarly chilled, ice forms and is removed to provide a concentrated juice.

Heat exchangers of the described types can use any cooling fluid on the shell side to cool a liquid flowing through the tubes. The fluid can be fed through one end and removed through the other end of the heat exchanger in a substantially unidirectional flow. Some suitable cooling fluids are ammonia and Freon brand refrigerants.

To obtain optimum heat exchange it is desirable in many instances for the tubes to be arranged vertically and for the feed liquid to be supplied to the tube surfaces as a downwardly flowing or falling liquid film. Not only is the feed liquid brought more quickly close to the temperature of the heat exchange liquid in this way but less recirculation of the liquids is required, thus reducing energy consumption.

Although it has been recognized for some time that control of the thickness of the falling film is desirable to obtain maximum heat exchange efficiency, available apparatus has not provided totally acceptable results and, in addition, the equipment cost and complexity has been greater than desired. Thus, Nail U.S. Pat. No. 4,335,581 discloses a heat exchanger with stub tubes which fit loosely into the open tops or mouths of the heat exchanger tubes so that the feed liquid can only flow downwardly between the tubes. Although such apparatus may be satisfactory for small size heat exchangers, it is not a desirable arrangement for large heat exchangers.

It is customary to locate heat exchange tubes more or less side-by-side in lines parallel to the tube sheet diameter. When the upper ends of the tubes are made flush with the top surface of the upper tube sheet, liquid fed to the top of the tube sheet will generally not be distributed uniformly to each tube mouth so that a constant falling film thickness and rate are not obtained. This adversely affects the efficiency of the heat exchange.

In an effort to improve liquid distribution to the tubes, the upper ends of the tubes have been extended up to twenty-four inches above the tube sheet surface. While this has led to somewhat improved liquid distribution to the tubes, satisfactory results were not achieved in large heat exchangers because of lack of flow control to all the tube mouths when the liquid feed was fed in at one or two locations.

A need accordingly exists for an improved falling film shell and tube heat exchanger which has means to control the flow of the liquid feed so as to constantly supply liquid to each tube in a substantially uniform amount.

SUMMARY OF THE INVENTION

According to the invention, there is provided a falling film heat exchanger comprising a shell connected to vertically spaced apart horizontally arranged circular upper and lower tube sheets; a plurality of vertically positioned parallel tubes, with each tube extending through and connected to a hole in each tube sheet; the tubes being positioned in a plurality of concentric rings; means to feed a heat exchange fluid to the shell side of the heat exchanger and means to withdraw it therefrom; a wall means around the top of the shell and joined thereto to retain a layer of liquid on the top of the upper tube sheet to a depth greater than the top of the tubes; a liquid distribution box, positioned above the upper tube sheet, having a bottom and upwardly extending peripheral wall; a plurality of short pipes extending downwardly from the box through which liquid can flow from the box interior through the pipes to the top of the upper tube sheet; the short pipes being positioned in a plurality of concentric rings which are spaced radially outwardly from an adjacent inner ring of pipes a distance about equal to the radial distance between the rings of tubes in the upper tube sheet, and with each ring of pipes radially aligned to be in alternating arrangement relative to the rings of tubes so that adjacent rings of tubes have a ring of pipes in midalignment therewith; and means to deliver feed liquid to the liquid distribution box.

It is generally desirable to have the top ends of the tubes of equal height above the upper tube sheet, and to have the lower ends of the pipes below the top ends of the tubes. However, the pipes can have their lower ends at or above the top ends of the tubes.

The falling film heat exchanger can have the distribution box stationary or it can be mounted for rotation about a vertical axis with the tubes stationary.

The distribution pipes can be metal or made of a polymeric material. When made of metal, the exterior of the pipes can be insulated.

The liquid distribution box can be insulated, as by including a polymeric bottom and peripheral wall. The pipes in such a box can be made of polymeric material and project downwardly from the polymeric bottom. The polymeric bottom can be supported on a metal plate having oversized holes through which the polymeric pipes extend.

To minimize corrosion, the distribution box can have a metal bottom from which metal anodes can extend downwardly to project between rings of the tube upper ends extending above the upper tube sheet.

A seal can be located between the distribution wall and the wall around the top of the shell to retard vapor flow around the liquid distribution pipes. This prevents deposition of ice when the apparatus is used as a freezer exchanger.

BRIEF DESCRIPTION OF THE DRAWINGS

FIG. 7 is an elevational view, partially in section, illustrating metal anodes projecting downwardly from the distribution box bottom;

FIG. 8 is a side view taken along the line 8—8 of FIG. 7; and

FIG. 9 is an elevational view, partially in section, illustrating a vapor seal spanning the space between the distribution box wall and the wall of the heat exchanger extending upwardly above the top of the tubes.

DETAILED DESCRIPTION OF THE DRAWINGS

To the extent it is reasonable and practical, the same numbers will be used to identify the same or similar elements or parts in the various views of the drawings.

Figure 1:
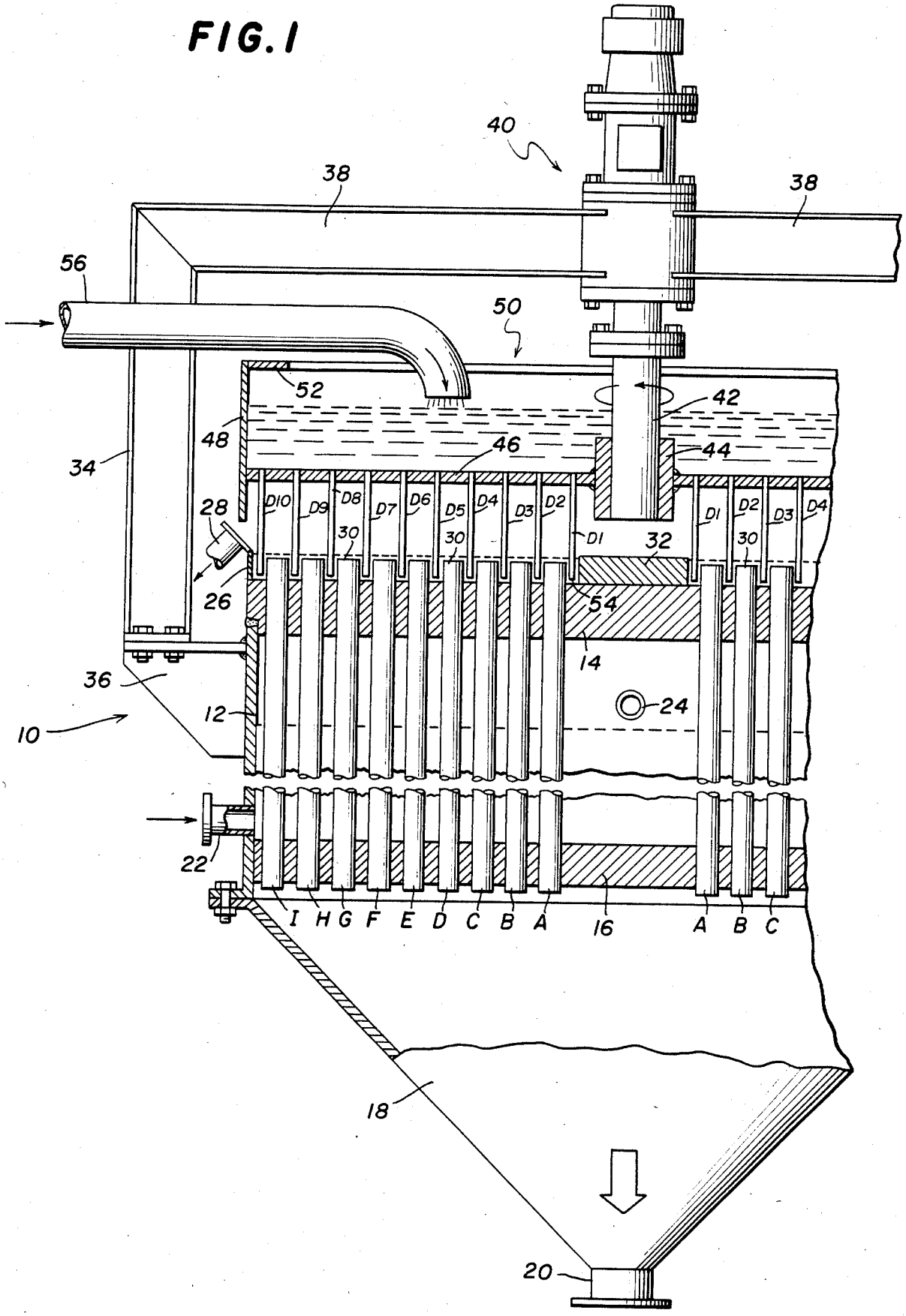
FIG. 1 is a partial elevational view, partially broken away and in section, of a heat exchanger according to the invention.

With reference to FIG. 1, the heat exchanger 10 has a vertical cylindrical circular metal shell 12 which is joined to upper tube sheet 14 and lower tube sheet 16. A conical end 18, connected to the lower end of shell 12, is provided with an exit port 20 through which liquid is removed from the tube side of the heat exchanger 10. Heat exchange fluid is fed to the shell side of the heat exchanger 10 through port 22 and is removed through upper port 24. Extending upwardly from the edge of upper tube sheet 14 is a peripheral wall 26 (FIGS. 1 and 2) provided with an overflow liquid drain pipe 28.

Figure 3:
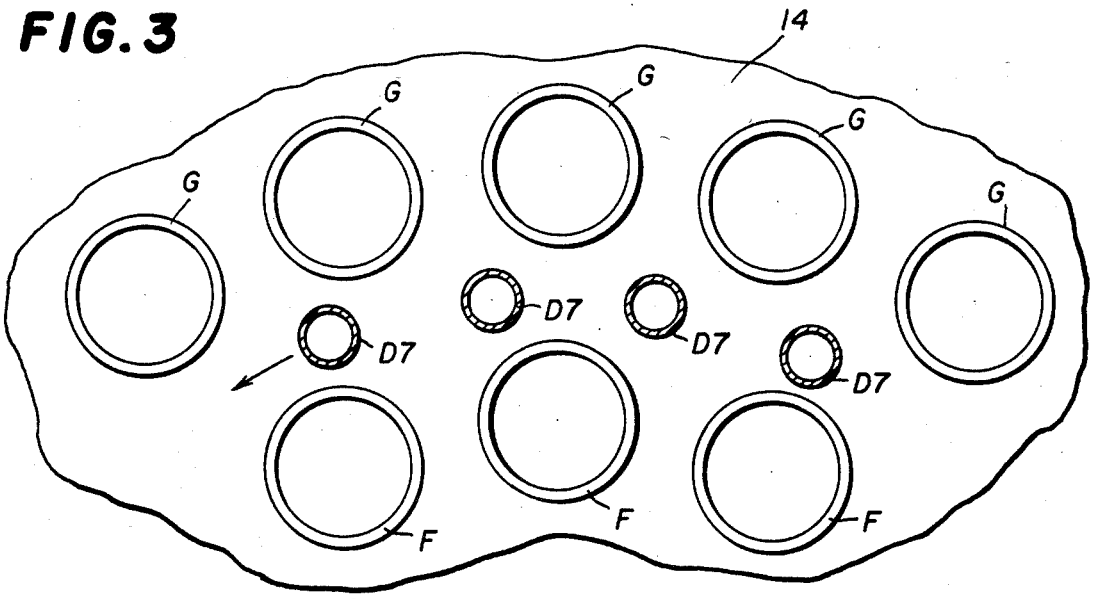
FIG. 3 is a partial plan view of the top of the upper tube sheet and tubes in the heat exchanger of FIGS. 1 and 2.

A plurality of parallel vertical heat exchange tubes A to I, generally of the same size, project through holes in the tube sheets 14 and 16. The tubes are pressure rolled into the holes in the tube sheets to form liquid tight joints. All of the tubes A to I are arranged in concentric circles (FIG. 3). Thus, a plurality of tubes A are arranged in one circle; a plurality of tubes B are arranged in a second but radially larger concentric circle; a plurality of tubes C are arranged in a third concentric circle radially larger than the circle containing tube B, and so on until the outermost concentric circle containing a plurality of tubes I. The radial distance between any adjacent pair of circles of tubes desirably is identical. However, the number of tubes in each circle will generally increase as the circumference increases since each tube is advisably positioned about the same distance from each adjacent tube irrespective of the circle involved.

The upper or top ends 30 of the tubes A to I extend above the upper surface of upper tube sheet 14 a short distance, such as two inches. A circular flat-sided block 32 is mounted axially on the top of tube sheet 14. Block 32 projects slightly above the tops 30 of the tubes and thus constitutes a dam restricting liquid flow into the tube top ends 30 or out drain pipe 28.

Two to four or more diametrically-opposite vertical legs 34 (FIG. 1—only one shown) are supported on brackets 36 joined to the upper part of shell 12. Supported radially from the tops of legs 34 is a horizontal drive support arm 38. Drive mechanism 40 is mounted on arm 38 and serves to rotate vertical shaft 42, such as at about one RPM.

Hub 44, mounted on the lower end of shaft 42, is axially positioned in horizontal circular bottom plate 46 spaced above tube sheet 14. Vertical circular cylindrical wall 48 is joined to the periphery of bottom plate 46 and projects upwardly therefrom. Bottom 46 and wall 48 form a liquid distribution box 50. Internally directed ring flange 52 is provided at the top of wall 48 to prevent liquid from splashing out.

The bottom plate 46 of liquid distribution box 50 is provided with a series of holes arranged in radially concentric circles, with adjoining circles desirably radially spaced an identical distance apart. Generally most or all of the holes are provided with liquid distribution pipes D1 to D10 which depend downwardly and, as shown in FIGS. 1 and 2, have a lower end 54 located slightly above the top surface of tube sheet 14.

A circle containing a plurality of distribution pipes D1 is concentrically positioned radially inside of the ring containing tubes A; a concentric circle containing a plurality of distribution pipes D2 is positioned concentrically and centrally between the circles of tubes A and B; and so on with a concentric circle containing a plurality of distribution pipes D10 positioned radially outside of, but close to, the circle containing tubes I. With the distribution pipes arranged as described, the distribution box is free to rotate with the distribution pipes unobstructed by the tube upper ends (FIGS. 1 to 3).

One or more inlet liquid feed conduits 56 is positioned to feed liquid to distribution box 50. Also, when the feed liquid is considerably above or below ambient temperature, it is often desirable to position a layer of insulation 58 (FIG. 2) against the lower surface of distribution box bottom 46.

Figure 2:
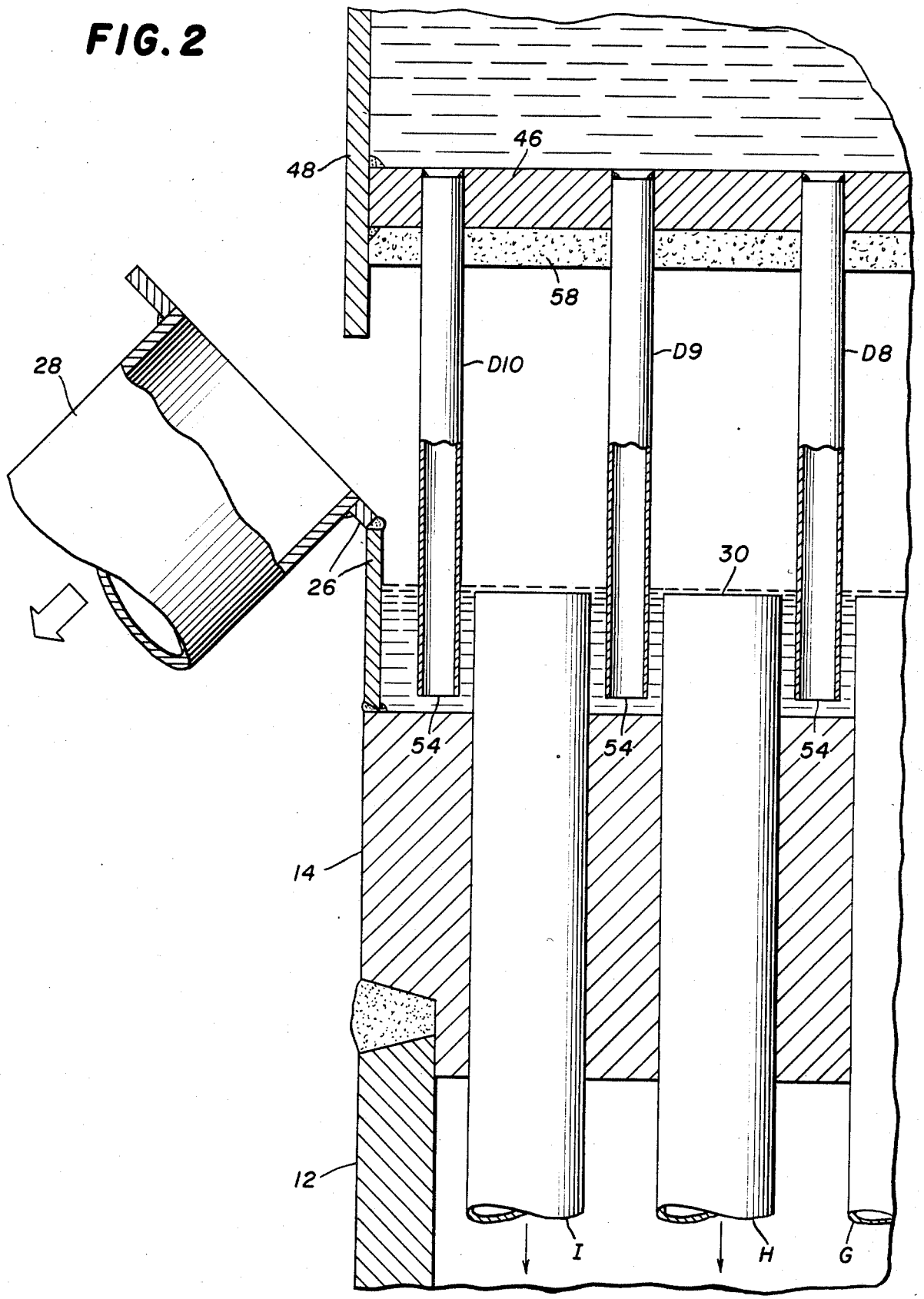
FIG. 2 is an enlarged elevational view, partially in section, showing some of the liquid distribution pipes and the tops of some of the tubes.

The heat exchanger illustrated by FIGS. 1 and 2 is especially useful as a freeze exchanger, particularly for concentrating aqueous solutions and dispersions. For example, it can be used to freeze-concentrate sea water by feeding the sea water to distribution box 50. The sea water flows through the circles of distribution tubes D1 to D10 onto the top surface of tube sheet 14. Once the liquid level rises on the tube sheet to the top 30 of the tubes it overflows into the tubes as a downwardly flowing thin film. This thin film of salt water is indirectly cooled by heat exchange with liquid ammonia on the shell side. The salt water is thereby cooled sufficiently to result in formation of ice crystals in the water. The resulting ice/water slurry flows out of the tubes into conical end 18 and then flows out through exit port 20. The slurry is desirably recirculated to the distribution box 50 to increase the amount of ice before it is sent to a separator to remove the ice from the now-concentrated salt water. The ice, after washing, can be melted to obtain potable water.

By use of the described apparatus, a more uniform feed of liquid to each tube is achieved than if the liquid is supplied directly by conduit 56 onto the top of tube sheet 14. This is so when the distribution box 50 is stationary, although even better results are usually obtained when the distribution box 50 is rotated.

Figure 4:
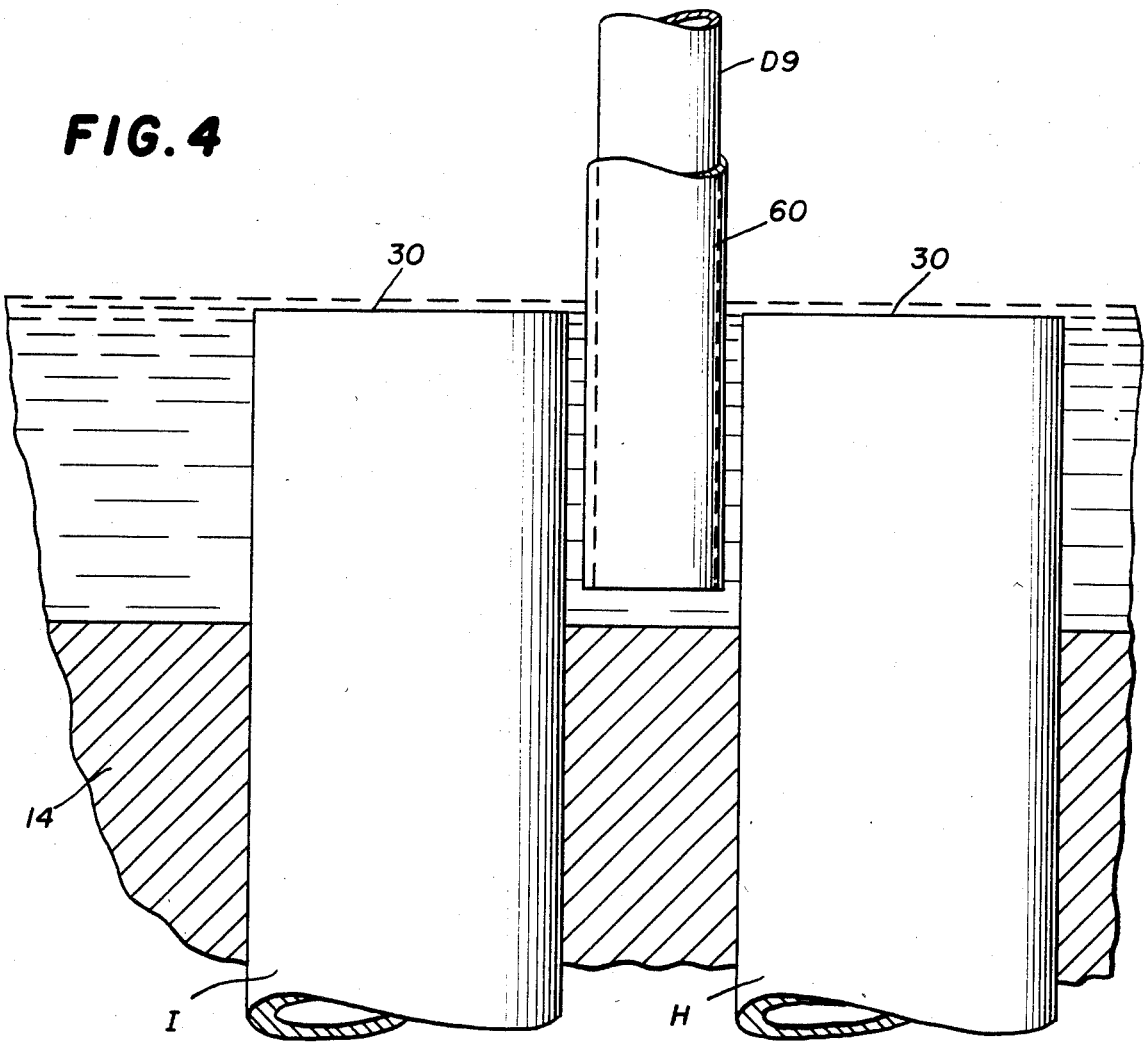
FIG. 4 is a partial elevational view, and partially in section, showing an insulated liquid distribution pipe.

When the apparatus is to be used as a freeze exchanger it is desirable to cover the exterior surfaces of the distribution pipes D1 to D10 with a polymeric insulating layer 60 as shown in FIG. 4 on pipe D9 to prevent ice deposits from forming on the pipes. Polyethylene, nylon and epoxy polymeric materials are suitable for this purpose.

Figure 5:
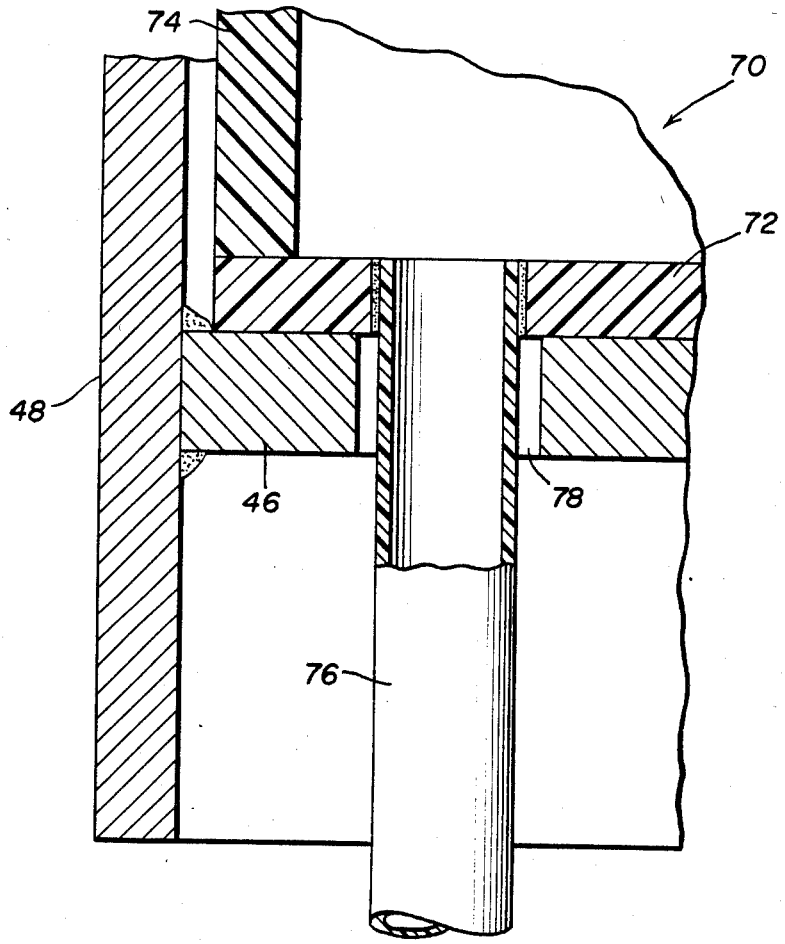
FIG. 5 is a vertical sectional view of a second embodiment of a liquid distribution box which can be used in the heat exchanger of FIG. 1.

FIG. 5 illustrates a second embodiment of liquid distribution box which can be employed in the apparatus of the invention. The distribution box 70 employs the metal bottom 46 and wall 48 already described. However, a circular sheet of polymeric insulating material 72 is mounted on the top of bottom 46. A vertical wall 74 of polymeric insulating material projects upwardly from the periphery of sheet 72. Distribution pipes 76 of polymeric material extend downwardly from sheet 72 through oversized holes 78 in metal bottom 46. The distribution pipes 76 are arranged in concentric rings like pipes D1 to D10 so as to have the feed liquid flow between the top end of the concentric rings of tubes. The distribution box 70 is particularly useful when the apparatus is employed as a freeze exchanger.

Figure 6:
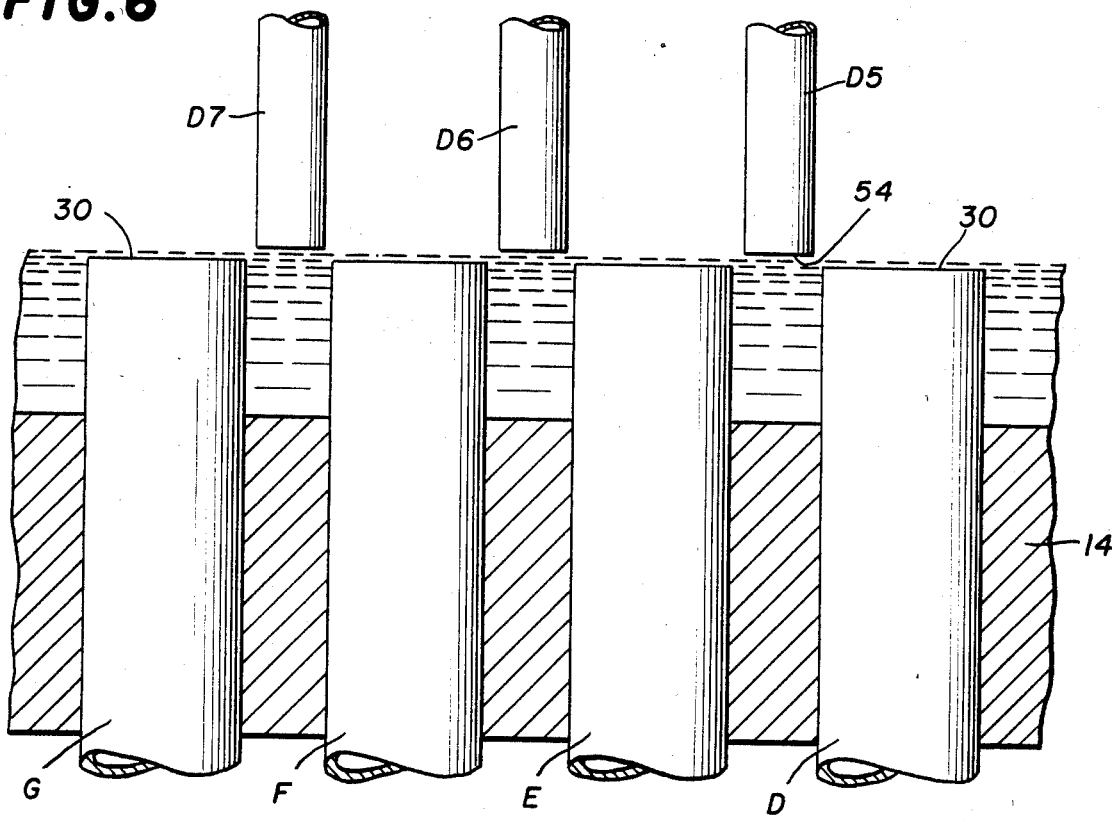
FIG. 6 is an elevational view, partially in section, illustrating liquid distribution pipes which have lower ends terminating slightly above the top ends of the heat exchanger tubes.

It is not essential, in all cases, for the lower ends 54 of the distribution pipes D1 to D10 to project below the top 30 of the tubes A to I. In some heat exchangers, even distribution of the liquid to the tubes can be achieved by having the lower ends 54 of the distribution pipes located at or slightly above the top 30 of the tubes as shown in FIG. 6.

When the apparatus of the invention is used in processing corrosion-inducing liquids, including sea water, anodes can be suitably positioned therein so as to provide anodic protection when an electric current is applied by suitable means well known in the art. A sufficient number of anodes can be installed by replacing some of the distribution pipes D1 to D10, in any suitable number of the concentric rings of pipes, with metal anode rods 80 as shown in FIGS. 7 and 8. The bottom portion 82 of each anode rod 80 can be widened to facilitate development of anodic protection.

To prevent condensation of water vapor and its freezing on the pipes and tube tops between tube sheet 14 and the bottom 46 of the distribution box by flow of air from the outside of the heat exchanger into that space, it is feasible to position a seal 90 between wall 48 of the distribution box and extension 92 of wall 26. The seal used is desirably one which permits the distribution box 50 to rotate while wall extension 92 is stationary. The construction of such seals is well within the skill of the art.

What is claimed is:

1. A falling film heat exchanger comprising:

a shell connected to vertically spaced apart horizontally arranged circular upper and lower tube sheets;

a plurality of vertically positioned parallel tubes, with each tube extending through and connected to a hole in each tube sheet;

the tubes being positioned in a plurality of concentric rings;

means to feed a heat exchange fluid to the shell side of the heat exchanger and means to withdraw it therefrom;

a wall means around the top of the shell and joined thereto to retain a layer of liquid on the top of the upper tube sheet to a depth greater than the top of the tubes;

a liquid distribution box, positioned above the upper tube sheet, having a bottom and upwardly extending peripheral wall;

means mounting the liquid distribution box for rotation about a vertical axis with the tubes stationary;

a plurality of short pipes extending downwardly from the box through which liquid can flow from the box interior through the pipes to the top of the upper tube sheet;

the short pipes being positioned in a plurality of concentric rings which are spaced radially outwardly from an adjacent inner ring of pipes a distance about equal to the radial distance between the rings of tubes in the upper tube sheet, and with each ring of pipes radially aligned to be in alternating arrangement relative to the rings of tubes so that adjacent rings of tubes have a ring of pipes in midalignment therewith; and means to deliver feed liquid to the liquid distribution box.

2. A falling film heat exchanger according to claim 1 in which the tubes have top ends of equal height above the upper tube sheet, and the pipes have lower ends below the top ends of the tubes.

3. A falling film heat exchanger according to claim 1 in which the tubes have top ends of equal height above the upper tube sheet, and the pipes have lower ends at or above the top ends of the tubes.

4. Apparatus according to claim 1 in which the pipes are metal and the exterior of the pipes is insulated.

5. Apparatus according to claim 1 in which the liquid distribution box includes a polymeric bottom and peripheral wall and the pipes are polymeric pipes projecting downwardly from the polymeric bottom.

6. Apparatus according to claim 5 in which the polymeric bottom is supported on a metal plate having oversized holes through which the polymeric pipes extend.

7. Apparatus according to claim 1 in which the distribution box has a metal bottom from which metal anodes extend downwardly to project between rings of the tube upper ends extending above the upper tube sheet.

8. Apparatus according to claim 1 including a seal between the distribution wall and the wall around the top of the shell to retard vapor flow around the liquid distribution pipes.

* * * * *